US012089718B2

(12) United States Patent
Tadros et al.

(10) Patent No.: US 12,089,718 B2
(45) Date of Patent: Sep. 17, 2024

(54) PROTECTIVE EYE SHIELD

(71) Applicant: David S. Tadros, Palm Beach Gardens, FL (US)

(72) Inventors: David S. Tadros, Palm Beach Gardens, FL (US); Alexis F. Tadros, Palm Beach Gardens, FL (US)

( * ) Notice: Subject to any disclaimer, the term of this patent is extended or adjusted under 35 U.S.C. 154(b) by 85 days.

(21) Appl. No.: 17/671,819

(22) Filed: Feb. 15, 2022

(65) Prior Publication Data

US 2022/0312939 A1 Oct. 6, 2022

Related U.S. Application Data

(60) Provisional application No. 63/171,160, filed on Apr. 6, 2021.

(51) Int. Cl.
*A45D 40/26* (2006.01)

(52) U.S. Cl.
CPC ..... *A45D 40/265* (2013.01); *A45D 2200/05* (2013.01)

(58) Field of Classification Search
CPC .... A45D 34/04; A45D 34/042; A45D 34/043; A45D 34/045; A45D 34/048; A45D 34/06; A45D 40/26; A45D 40/262; A45D 40/264; A45D 40/265; A45D 2034/002; A45D 2040/0006; A45D 2200/10
USPC ..... 132/319, 218, 285, 317, 318
See application file for complete search history.

(56) References Cited

U.S. PATENT DOCUMENTS 5,052,839 A * 10/1991 Pettengill ..... A45D 40/265 401/129
5,970,990 A * 10/1999 Dunton ..... A46B 3/18 401/39
6,026,825 A * 2/2000 de Laforcade ..... A46B 3/18 401/122
7,997,820 B2 * 8/2011 Bouix ..... A45D 40/24 401/35
8,434,959 B2 * 5/2013 Bennett ..... A45D 40/265 132/316

(Continued)

FOREIGN PATENT DOCUMENTS

EP 0162722 * 11/1985 ..... A45D 40/26
JP 2011218061 * 11/2011 ..... A45D 44/12

(Continued)

*Primary Examiner* — Jacqueline T Johanas
*Assistant Examiner* — Leah Badger
(74) *Attorney, Agent, or Firm* — Epstein Drangel LLP; Robert L. Epstein

(57) ABSTRACT

The mascara applicator includes a container with a removeable cap. A brush extends from the cap such that when the cap is mounted on the container, bristles on the end portion of the brush shaft pick up mascara within the container. An elongated shield extends from the cap in a direction parallel to the brush shaft and spaced from the brush shaft a short distance. The shield prevents excess mascara from being deposited on the eyelid of the user as the mascara is applied. The distance between the shield member and the brush shaft remains constant while the applicator is in use. In one embodiment, the shield member is rigid and not retractable into the cap. In a second embodiment, the shield is foldable into a recess in the cap wall. In a third embodiment, the shield is telescopically received in a slot in the cap when retracted.

4 Claims, 3 Drawing Sheets

(56) References Cited

U.S. PATENT DOCUMENTS

| | | | | |
|---|---|---|---|---|
| 2010/0095975 | A1* | 4/2010 | Kim | A45D 40/265<br>132/218 |
| 2017/0231368 | A1* | 8/2017 | Navarro | A45D 40/18<br>132/218 |

FOREIGN PATENT DOCUMENTS

| | | | | |
|---|---|---|---|---|
| JP | 2012105797 | * | 6/2012 | A45D 34/04 |
| KR | 20130003633 A | * | 1/2013 | A45D 34/043 |
| KR | 20200056211 A | * | 5/2020 | A45D 29/18 |

* cited by examiner

PROTECTIVE EYE SHIELD

CROSS-REFERENCE TO RELATED APPLICATIONS

Priority is claimed on Provisional Patent Application No. 63/171,160, filed Apr. 6, 2021, the contents of which are incorporated herein by reference.

STATEMENT REGARDING FEDERALLY SPONSORED RESEARCH OR DEVELOPMENT

Not Applicable

REFERENCE TO A "SEQUENCE LISTING", A TABLE, OR A COMPUTER PROGRAM LISTING APPENDIX SUBMITTED ON COMPACT DISC

Not Applicable

BACKGROUND OF THE INVENTION

1. Field of the Invention

The present invention relates to cosmetic applicators and more particularly to a mascara applicator including a shield which prevents excess mascara from being deposited on the eyelids of the user as the mascara is applied to the eyelashes.

2. Description of Prior Art Including Information Disclosed Under 37 CFR 1.97 and 1.98

Mascara is commonly sold by mascara manufacturers in cylindrical containers which have a hollow body defining a cavity in which the mascara is situated and a removeable screw cap which allows access to the mascara when removed. The cap includes an applicator brush attached to and extending from the interior surface of the cap. The brush includes a shaft with brush bristles radially extending from the end portion.

When the cap is in place on the container, the end portion of the brush extends into the container cavity such that the bristles of the brush can pick up the mascara. When the cap is removed from the container by the user, the mascara-laden brush bristles carry the mascara from the container and the user can manipulate the brush by holding the cap to apply the mascara from the brush bristles to the eyelid of the user.

However, application of mascara with the brush in this manner often results in excess mascara being deposited on the eyelid of the user, which may be difficult and messy to remove.

Accordingly, there is a need for a simple, inexpensive means of preventing excess mascara from being deposited on the eyelid of the user during the mascara application procedure. That need is met by the present invention which is a shield attached to and extending from the container cap in a direction parallel to the shaft of the brush and spaced from the brush shaft by a short distance.

The protective shield is dispatched as the cap is removed from the container and returned to its storage position within the container when the cap is mounted on the container.

BRIEF SUMMARY OF THE INVENTION

The invention is a cosmetic applicator including a container for retaining a cosmetic such as mascara and a removeable cap which allows access to the cosmetic in the container. The applicator includes a brush with a shaft attached to and extending from the cap. A protective shield is provided to prevent excess amounts of the cosmetic from being applied to the eyelid of the user as the user applies the mascara. The shield is attached to and extends from the cap. The shield is situated parallel to but spaced a short distance from the brush shaft.

The protective shield is attached to the cap of the container such that the shield is exposed as the cap is removed from the container. The shield is stored within the container cap when the cap is mounted on the container.

Three preferred embodiments of the protective eye shield are presented. In one embodiment, the shield is rigid and fixed to the cap of the container such that it is and remains parallel to the brush shaft. The shield is spaced from the brush shaft by a short distance which remains constant when the applicator is in use.

In another embodiment, the shield has two sections connected by a first hinge. A second hinge connects one of the sections to the container cap. In the retracted position, the sections are in a folded side-by-side relation within a recess in the exterior of the cap wall. When the cap is removed from the container body, the folded shield sections are pivoted relative to the container cap and the sections are unfolded such that the shield is parallel to the brush shaft.

In another embodiment, the shield is telescopically received in a slot in the cap wall. The shield includes two sections. One section is attached to the cap and is normally in a retracted position within the slot. The second section is telescopically situated within the first section. The shield can be moved linearly along the slot from its retracted position to a position where it extends from the container cap. In the extended position of the shield, the second section is extracted from the first section such that the shield is fully extended and positioned for use parallel to the brush shaft.

In accordance with one aspect of the present invention, a cosmetic applicator is provided including a container having a wall defining a cavity for retaining a cosmetic. The container has a neck with an opening and a cap attached to and removeable from the container to expose the neck opening. A brush is provided including a shaft having an end attached to and extending from the cap and an unattached end having an end portion. Brush bristles extend outwardly from the end portion of the shaft. An elongated shield member extends from the cap in a direction parallel to the brush shaft and is spaced from the brush shaft a short distance. The distance between the shield member and the brush shaft remains constant while the applicator is in use.

The applicator has a channel in the container wall adapted to receive the shield member when the cap is attached to the container. The container has a central axis. The channel extends within the container wall in a direction parallel to the axis of the container.

The top of the applicator container has a neck. The cap engages the neck. The neck has an external protrusion. The cap has an internal channel adapted to receive the protrusion when the cap is mounted on the container. The protrusion preferably takes the form of a circumferential protrusion or thread. The cap snaps onto the neck of the container.

The cosmetic which the applicator is designed to apply is mascara.

The shield may be foldable into a recess in the cap wall or may be telescopically attached to the cap and retractable into a slot in the cap wall.

In accordance with another aspect of the present invention, a cosmetic applicator is provided including a container defining a cavity for retaining a cosmetic. The container includes a top with an opening. A cap is attached to and removeable from the container to expose the neck opening. The cap includes a recess. A brush including a shaft extends from the cap and has an unattached end having an end portion. Brush bristles extend outwardly from the end portion of the brush shaft. An elongated shield member is pivotally attached to cap for movement between a retracted position within the cap recess and an extended position parallel to the brush shaft.

The shield member includes a first section and a second section flexibly connected to fold into the cap recess. The container has a central axis. The cap recess extends in a direction parallel to the container axis.

The container body top has a neck. The cap engages the neck. The neck has an external screw thread. The cap has an internal channel adapted to receive the external screw thread.

In accordance with another aspect of the present invention, a cosmetic applicator is provided including a container body defining a cavity for retaining a cosmetic. The container body includes a top that has an opening. A cap is attached to and removeable from the container to expose the top opening. The cap has a slot. A brush including a shaft extends from the cap. The brush has an unattached end portion. Brush bristles extend outwardly from the brush shaft end portion. An elongated shield member is telescopically connected to the cap for movement between a retracted position within the cap slot and an extended position parallel to the brush shaft.

The shield member includes a first section and a second section. The first section is telescopically attached to and received within the second section. The first section of the shield member is situated within the second section when the shield member is received in the cap slot.

The container has a central axis. The cap slot extends within the cap in a direction parallel to the axis.

The container top has a neck. The cap engages the neck. The neck includes an external screw thread. The cap has an internal channel adapted to receive the external screw thread when the cap is mounted on the container.

BRIEF DESCRIPTION OF THE SEVERAL VIEWS OF DRAWINGS

To these and to such other objects that may hereinafter appear, the present invention relates to a cosmetic applicator including a protective eye shield as described in detail in the following specification and recited in the annexed claims, taken together with the accompanying drawings in which:

Figure 6:
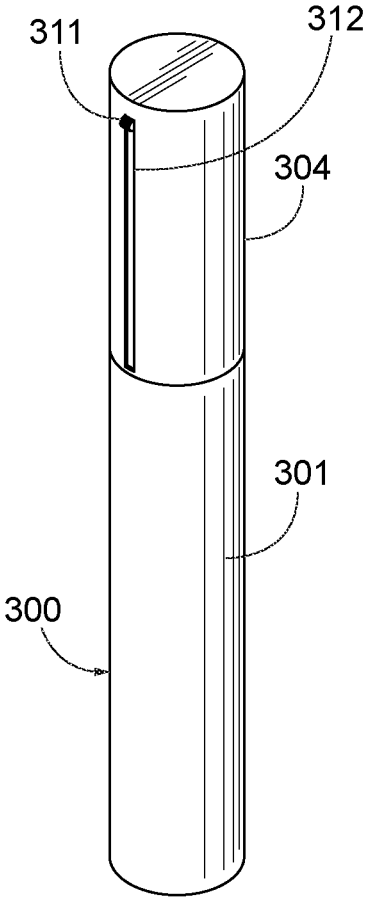
Figure 7:
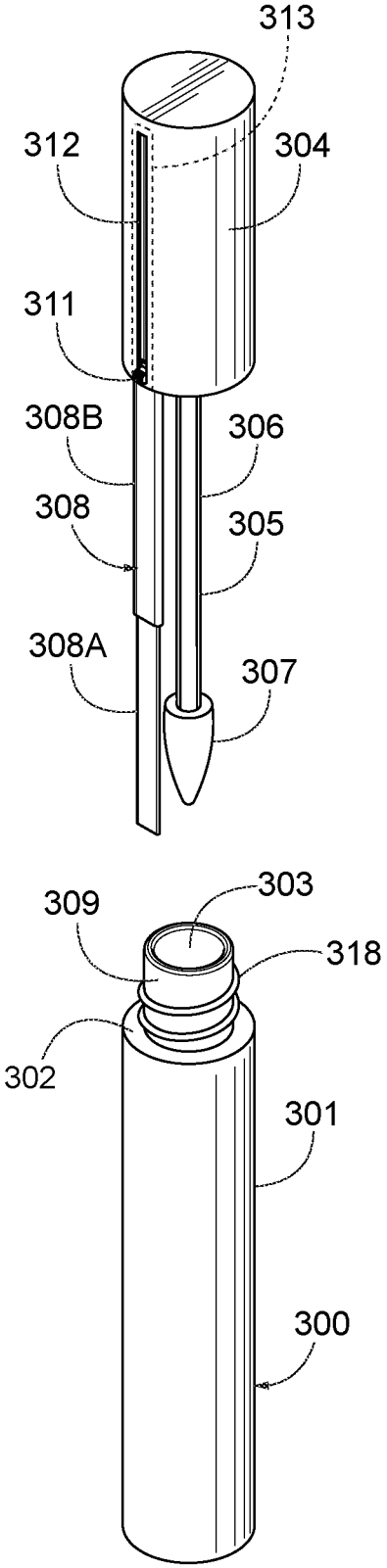

FIG. 6 is a perspective view of the applicator of the third preferred embodiment showing the side and top of the applicator with the cap mounted on the container and the shield member received in the cap slot; and FIG. 7 is a perspective view of the applicator of the third preferred embodiment showing the side and top of the applicator with the cap exploded from the container and the shield member extended.

DETAILED DESCRIPTION OF THE INVENTION

In all three embodiments of the cosmetic applicator of the present invention, the applicator includes a hollow container body (100, 200, 300) having wall (101, 201, 301) defining a cavity for retaining a cosmetic, such as mascara. The container body is shown as being cylindrical for purposes of illustration. However, the container can be of any suitable shape or size.

The container has a top (102, 202, 302) with an opening (103, 203, 303). A cap (104, 204, 304) is attached to and removeable from the container body to expose the top opening.

A brush (105, 205, 305) is provided. The brush includes a shaft (106, 206, 306). The shaft has an end attached to and extending from the interior surface of the cap. The shaft also has an unattached end having an end portion. A set of radially extending brush bristles (107, 207, 307) is situated on and extends outwardly from the end portion of the shaft.

An elongated shield member (108, 208, 308) is associated with the cap. In its extended position, the shield member extends from the cap in a direction parallel to the shaft of the brush shaft. The shield member is spaced a short distance from the brush shaft.

The container top has a hollow neck (109, 209, 309). The cap engages the neck to close the opening on the top of the container body. The neck has an external protrusion (113, 218, 318). The interior surface of the cap wall has an internal channel adapted to receive the protrusion when the cap is mounted on the container body.

In the first preferred embodiment, shield member 108 is made of rigid material and is parallel to brush shaft 106. The distance between the shield member and the brush shaft remains constant throughout the cosmetic application procedure.

Figure 1:
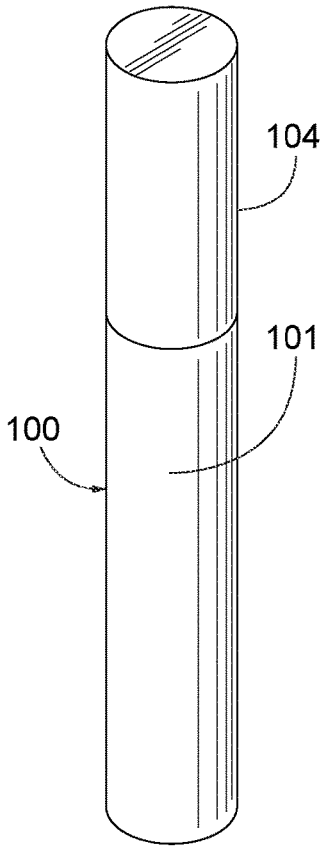
FIG. 1 is a perspective view of the applicator of the first preferred embodiment showing the side and top of the applicator with the cap mounted on the container.
Figure 2:
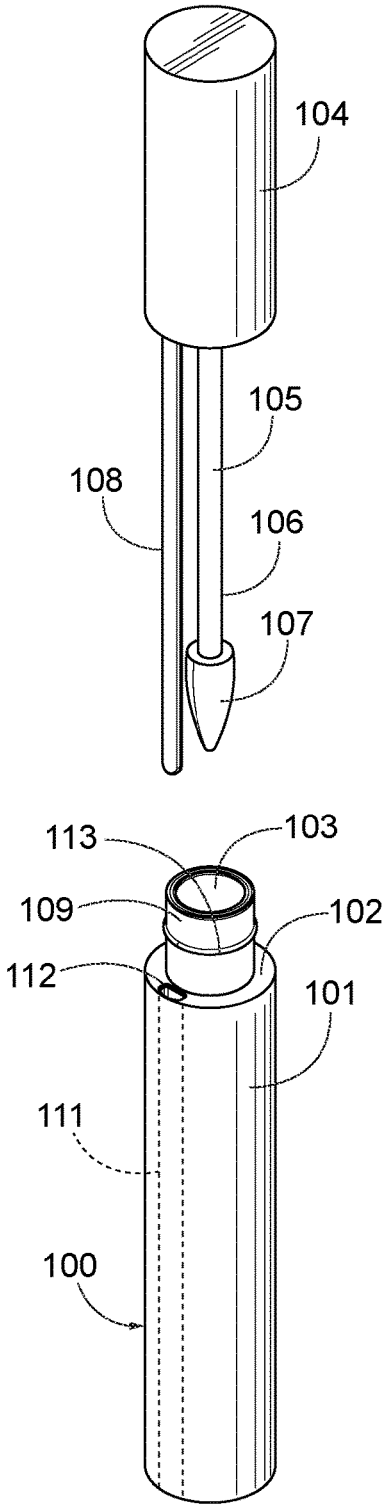
FIG. 2 is a perspective view of the applicator of the first preferred embodiment showing the side and top of the applicator with the cap exploded from the container.
Figure 3:
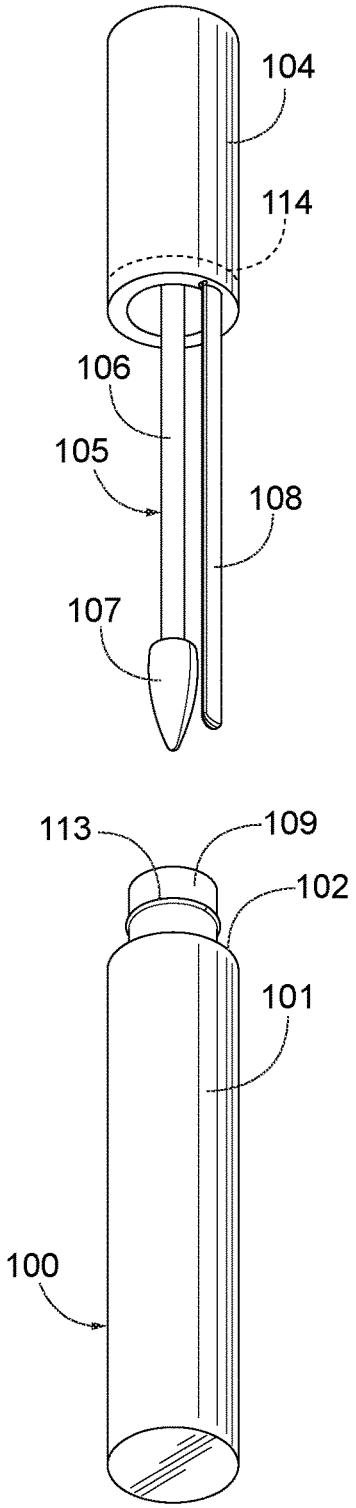
FIG. 3 is a perspective view of the applicator of the first preferred embodiment showing the side and bottom of the applicator with the cap exploded from the container.

As best seen in FIGS. 1, 2 and 3, wall 101 of container 100 has an internal channel 111 with an opening 112. Channel 111 extends in a direction parallel to the central axis of container body 100. When cap 104 is mounted on container 100, shield member 108 is received within channel 111. Shield member 108 is withdrawn from channel 111 when the cap 104 is removed.

Neck 109 has a single circumferential protrusion 113. The internal surface of cap 104 has a channel 114, which is designed to receive protrusion 113 such that the cap 104 can snap on to neck 109 and thus be mounted on the container body 100.

Figure 4:
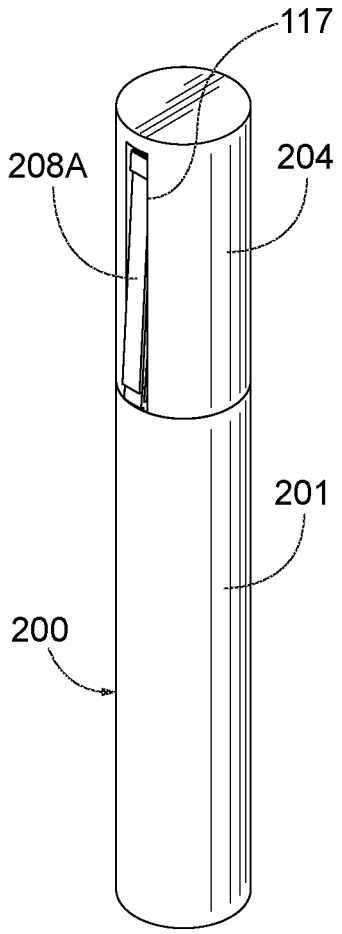
FIG. 4 is a perspective view of the applicator of the second preferred embodiment showing the side and top of the applicator with the cap mounted on the container and the shield member folded into the cap recess.
Figure 5:
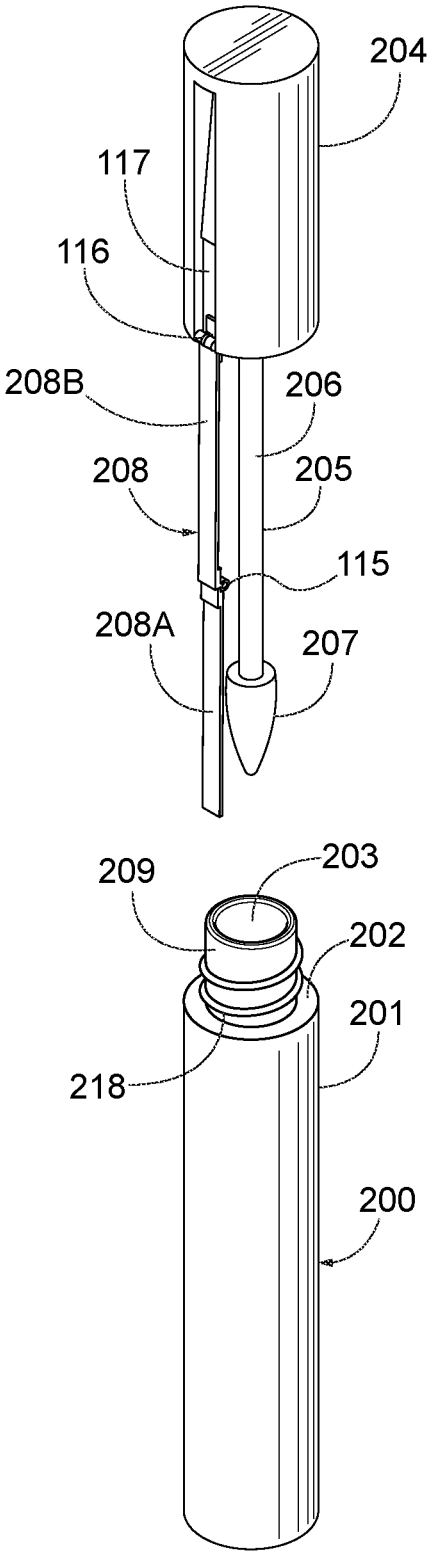
FIG. 5 is a perspective view of the applicator of the second preferred embodiment showing the side and bottom of the applicator with the cap exploded from the container and the shield member extended.

As best seen in FIGS. 4 and 5, in the second preferred embodiment, the shield member has two sections 208A and 208B the ends of which are connected by a hinge 115. The other end of section 208B is connected to cap 204 by a second hinge 116 located at the mouth of recess 117 in the wall of cap 204.

Shield member 208 can be folded into recess 117 when not in use. When cap 204 is moved out of recess 117 and unfolded to the extended position, as seen in FIG. 5, applicator 200 is ready for use.

Neck 209 is provided with an external screw thread 218. Within cap 204 is a helical channel (not shown) which mates with screw thread 218 of neck 209 such that the cap 204 can be mounted on and removed from container body 200 be rotating the cap relative to the container, as is common for cosmetic containers.

In the third preferred embodiment, as seen in FIGS. 6 and 7, shield member 308 includes two sections 308A and 308B. Section 308B is hollow and wider than Section 308A. Section 308A can slide inside Section 308B. Section 308B can slide into a slot 313 within the wall of cap 304. The surface of section 308B has a protrusion 311 which rides along an elongated opening 312 in the cap wall to guide the movement of section 308B within slot 313.

FIG. 7 shows shield 308 in its extended position, parallel to and spaced from brush shaft 306. To move shield 308 to its retracted position, as seen in FIG. 6, section 308A is moved toward the top of the cap 304 into section 308B. Then section 308B (with section 308A inside) is then moved toward the top of cap 304 into slot 313, as protrusion 311 is moved up along opening 312. In this way, the shield member 308 is telescopically retracted into cap 304.

Once shield member 308 is situated within cap 304, the cap can be mounted on neck 309 which is provided with an external screw thread 318. Within cap 304 is a helical channel (not shown) which mates with screw thread 318 of neck 309 such that the cap 304 can be mounted on and removed from container body 300 be rotating the cap relative to the container, as is common for cosmetic containers.

While only a limited number of preferred embodiments of the present invention have been disclosed for purposes of illustration, it is obvious that many modifications and variations could be made thereto. It is intended to cover all of those modifications and variations which fall within the scope of the present invention, as defined by the following claims.

We claim:

1. A cosmetic applicator comprising a container defining a cavity for retaining a cosmetic, said container comprising an opening and a cap attached to and removeable from said container to expose said opening, said cap comprising a recess, a brush comprising a shaft extending from said cap, said shaft having an unattached end, said unattached end having an end portion, bristles extending outwardly from said end portion of said shaft, and wherein said cap further comprises an elongated shield member, said shield member being pivotally attached to said cap for movement between a retracted position within said recess and an extended position parallel to said brush shaft, wherein said shield member comprises two sections flexibly connected to fold into said recess.

2. The applicator of claim 1 wherein said container has an axis and wherein said recess extends in a direction parallel to said container axis.

3. The applicator of claim 1 wherein said container comprises a neck and wherein said cap engages said neck.

4. The applicator of claim 3 wherein said neck comprises an external screw thread and wherein said cap has an internal channel adapted to receive said external screw thread.

* * * * *